US010569117B2

(12) United States Patent
Lo

(10) Patent No.: US 10,569,117 B2
(45) Date of Patent: Feb. 25, 2020

(54) EXERCISE MACHINE

(71) Applicant: DK City Corporation, Taichung (TW)

(72) Inventor: Chiu-Hsiang Lo, Taichung (TW)

(73) Assignee: DK CITY CORPORATION, Taichung (TW)

( * ) Notice: Subject to any disclaimer, the term of this patent is extended or adjusted under 35 U.S.C. 154(b) by 145 days.

(21) Appl. No.: 15/707,141

(22) Filed: Sep. 18, 2017

(65) Prior Publication Data

US 2019/0083838 A1 Mar. 21, 2019

(51) Int. Cl.

| | |
|---|---|
| ***A63B 21/00*** | (2006.01) |
| ***A63B 21/005*** | (2006.01) |
| ***A63B 22/02*** | (2006.01) |
| ***A63B 23/04*** | (2006.01) |
| ***A63B 21/015*** | (2006.01) |
| *A63B 22/06* | (2006.01) |
| *A63B 22/00* | (2006.01) |

(52) U.S. Cl.

CPC .... *A63B 21/00069* (2013.01); *A63B 21/0051* (2013.01); *A63B 21/00061* (2013.01); *A63B 21/00192* (2013.01); *A63B 21/015* (2013.01); *A63B 21/154* (2013.01); *A63B 22/02* (2013.01); *A63B 23/0405* (2013.01); *A63B 22/0076* (2013.01); *A63B 22/0664* (2013.01); *A63B 2209/08* (2013.01)

(58) Field of Classification Search

CPC ..... A63B 21/00069; A63B 21/00192; A63B 22/02; A63B 21/0051; A63B 21/00061; A63B 21/154; A63B 23/0405; A63B 2209/08

See application file for complete search history.

(56) References Cited

U.S. PATENT DOCUMENTS

| | | | | |
|---|---|---|---|---|
| 9,675,838 | B2 * | 6/2017 | Manzke | A63B 21/00069 |
| 2014/0274578 | A1 | 9/2014 | Kennedy | |
| 2015/0080189 | A1 * | 3/2015 | Villani | A63B 22/02 482/54 |
| 2015/0209610 | A1 * | 7/2015 | Dalebout | A63B 22/02 482/54 |
| 2016/0166877 | A1 * | 6/2016 | Cei | A63B 22/02 482/54 |

FOREIGN PATENT DOCUMENTS

| | | |
|---|---|---|
| TW | 448063 B | 8/2001 |
| TW | I593444 | 8/2007 |

* cited by examiner

*Primary Examiner* — Sundhara M Ganesan

(74) *Attorney, Agent, or Firm* — Muncy, Geissler, Olds & Lowe, PC

(57) ABSTRACT

An exercise machine includes a training unit, a transmission unit and an impedance system. The training unit includes a roller. The transmission unit is connected to the roller. The impedance system includes several impedance units adapted for selective connection to the transmission unit so that the selected impedance unit exerts impedance on the training unit. The impedance units exert different values of impedance on the training unit via the transmission unit.

11 Claims, 7 Drawing Sheets

EXERCISE MACHINE

BACKGROUND OF INVENTION

1. Field of Invention

The present invention relates to an exercise machine and, more particularly, to an exercise machine comprises several impedance units made with a same structure but provides different values of impedance.

2. Related Prior Art

There are various exercise machines such as treadmills, rowing trainers and elliptic trainers. An exercise machines is electric or non-electric.

As disclosed in Taiwanese Patent No. 448063, a non-electric treadmill includes a tread belt and a frictional impedance unit. The tread belt is wound on two rollers. The frictional impedance unit includes a brake belt wound on one of the rollers. The brake belt exerts a frictional force on the corresponding roller, thereby providing impedance against the movement of the tread belt. However, the value of impedance is not adjustable.

In US Patent Application Publication No. 2014/0274578A1, disclosed is a treadmill that includes a tread belt and a magnetic impedance unit. The tread belt is wound on two rollers. The magnetic impedance unit includes a pulley and a permanent magnet. The pulley is connected to one of the rollers so that they are rotatable together. The permanent magnet produces an Eddy Current in the pulley to impede the rotation of the pulley and the corresponding roller. The magnetic impedance unit is adjustable. However, the magnetic impedance unit does not provide impedance as large as the above-mentioned frictional impedance unit does.

As disclosed in Taiwanese Patent No. 1593444, an exercise machine is provided with a combinative impedance apparatus that includes a brake belt, a pulley, permanent magnet and a metal disc. The exercise machine includes a tread belt wound on two rollers. The pulley is connected to one of the rollers. The brake belt is wound on one of the pulley. The brake belt exerts a frictional force on the corresponding roller, thereby providing impedance against the movement of the tread belt. The permanent magnet produces an Eddy Current in the metal disc to reduce the rotation of the metal disc and the corresponding roller.

The present invention is therefore intended to obviate or at least alleviate the problems encountered in prior art.

SUMMARY OF INVENTION

It is the primary objective of the present invention to provide an exercise machine operable under an adjustable value of impedance.

To achieve the foregoing objective, the exercise machine includes a training unit, a transmission unit and an impedance system. The training unit includes a roller. The transmission unit is connected to the roller. The impedance system includes several impedance units adapted for selective connection to the transmission unit so that the selected impedance unit exerts impedance on the training unit. The impedance units exert different values of impedance on the training unit via the transmission unit.

In an alternative aspect, the impedance system includes a metal disc, two swinging elements and two pairs of magnets. The metal disc is connected to the transmission unit so that they are rotatable together. The swinging elements are connected to the frame. The first pair of magnets is connected to the first swinging element. The second pair of magnets is connected to the second swinging element. The first swinging element is operable to move the first pair of magnets to the disc. The second swinging element is operable to move the second pair of magnets to the disc.

Other objectives, advantages and features of the present invention will be apparent from the following description referring to the attached drawings.

BRIEF DESCRIPTION OF DRAWINGS

The present invention will be described via detailed illustration of seven embodiments referring to the drawings wherein.

DETAILED DESCRIPTION OF EMBODIMENTS

Figure 1:
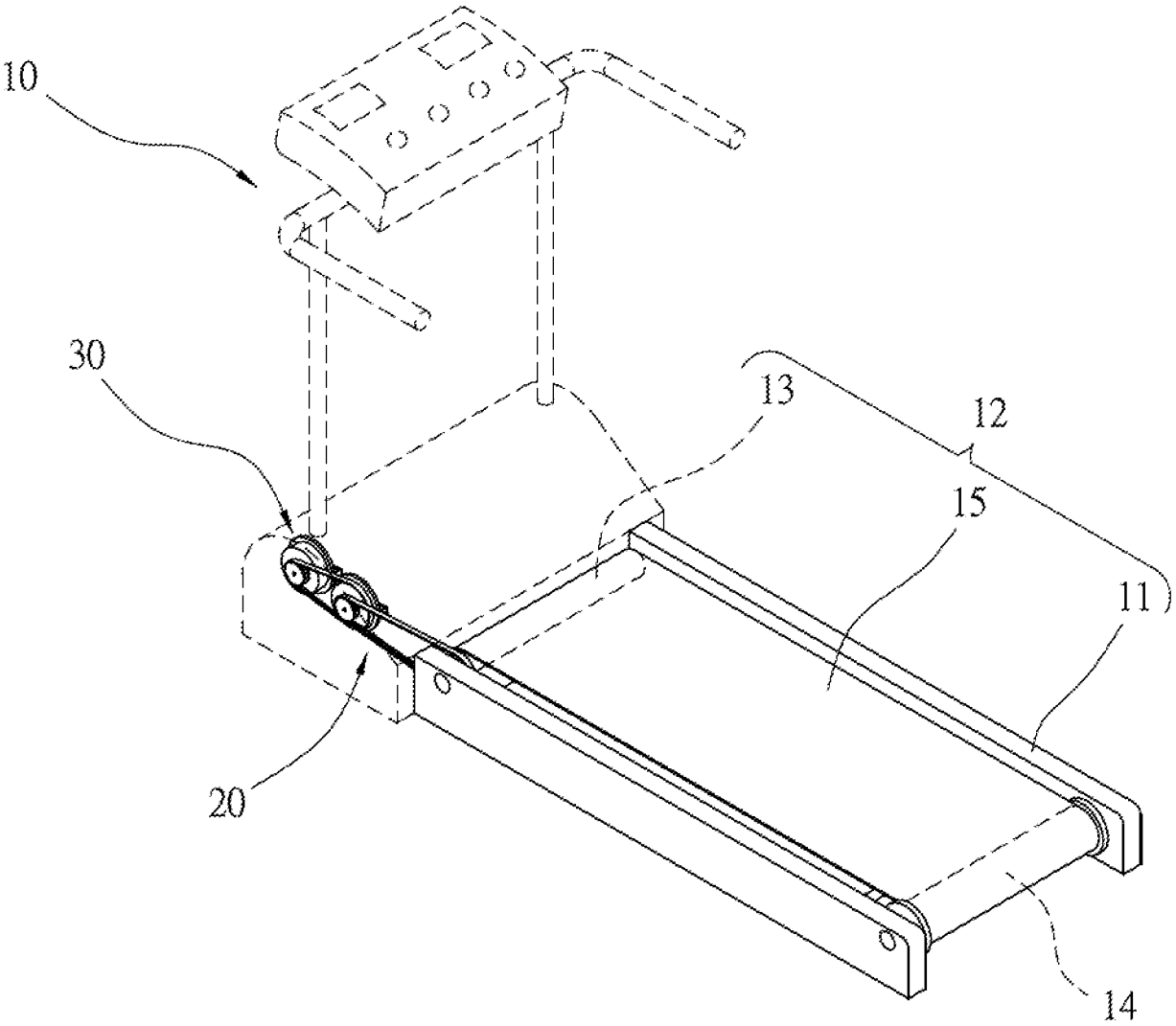
FIG. 1 is a perspective view of an exercise machine equipped with a transmission unit and an impedance system according to the first embodiment of the present invention.
Figure 2:
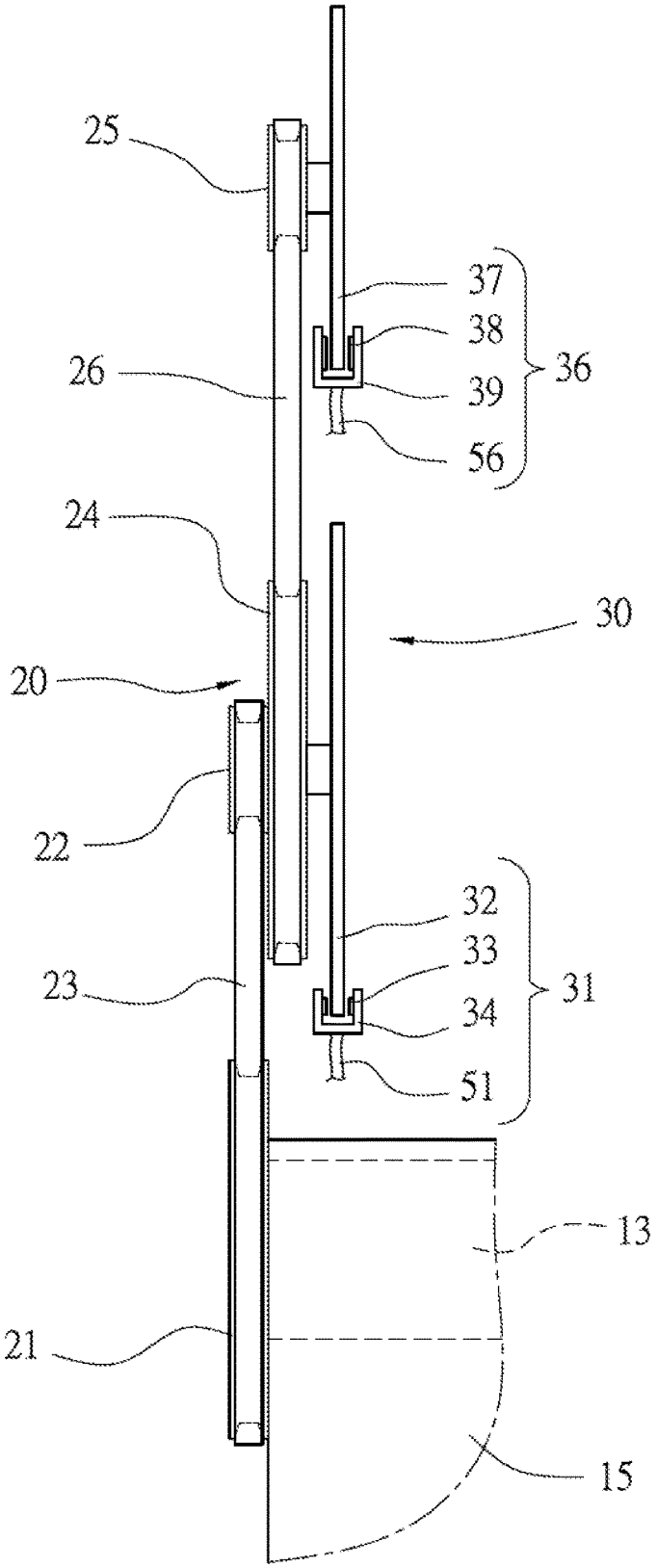
FIG. 2 is a top view of the transmission unit and the impedance system shown in FIG. 1.

Referring to FIGS. 1 and 2, an exercise machine 10 is a treadmill according to a first embodiment of the present invention. However, exercise machine 10 can be a rowing trainer or an elliptical trainer in another embodiment. Exercise machine 10 includes a training unit 12, a transmission unit 20 and an impedance system 30. Transmission unit 12 and impedance system 30 are supported on a front portion of the training unit 12. Impedance system 30 exerts impedance against the movement of training unit 12 via transmission unit 20.

Training unit 12 includes a frame 11, two rollers 13 and 14 and a tread belt 15. Roller 13 is supported on a front portion of frame 11, and roller 14 a rear portion of frame 11. Rollers 13 and 14 are allowed to rotate freely on frame 11. Tread belt 15 is a loop wound on rollers 13 and 14. There is friction between tread belt 15 and rollers 13 and 14. Hence, rollers 13 and 14 are rotated on frame 11 when tread belt 15 is moved.

Transmission unit 20 includes pulleys 21, 22, 24 and 25 and two transmitting belts 23 and 26. In the preferred embodiment, pulley 21 is connected to roller 13 so that they are rotated together as tread belt 15 is moved. However, in another embodiment, pulley 21 can be connected to roller 14 so that they are rotated together when tread belt 15 is moved. Transmitting belt 23 is wound on pulleys 21 and 22. Pulley 24 is co-axially connected to pulley 22 so that they are rotatable together. Transmitting belt 26 is wound on fourth pulleys 24 and 25. Thus, pulleys 21, 22, 24 and 25 are rotated with roller 13 when tread belt 15 is moved.

The diameter of pulley 21 is lager than that of pulley 22 so that the rotational rate of pulley 21 is lower than that of pulley 22. The diameter of pulley 24 is larger than that of pulley 25 so that the rotational rate of pulley 24 is lower than that of pulley 25. Hence, the rotational rate of pulley 21 is much lower than that of pulley 25.

Impedance system 30 includes two impedance units 31 and 36 in the first embodiment. However, impedance system 30 can include another amount of impedance units in another embodiment. Impedance units 31 and 36 are structurally identical to each other but provide different values of impedance.

Impedance unit 31 includes a metal disc 32, at least one pair of magnets 33 and a swinging element 34. Metal disc 32 is coaxially connected to pulleys 22 and 24 so that metal disc 32 is rotated with roller 13 when tread belt 15 is moved. Magnets 33 are attached to swinging element 34, one located near a side of metal disc 32 and the other located near another side of metal disc 32. Each magnet 33 is preferably located near metal disc 32. Each magnet 33 is preferably a permanent magnet. Swinging element 34 is pivotally connected to frame 11 and can be reciprocated relative to metal disc 32. A cable 51 is connected to swinging element 34 so that the former is operable to move the latter from metal disc 32, i.e., move magnets 33 from metal disc 32.

Similarly, impedance unit 36 includes a metal disc 37, at least one pair of magnets 38 and a swinging element 39. The interrelation of metal disc 37, magnets 38 and swinging element 39 is identical to that of metal disc 32, magnets 33 and swinging element 34. Metal disc 37 is coaxially connected to pulley 25. Each magnet 38 is preferably a permanent magnet. A cable 56 is tied to swinging element 39 so that the former is operable to pull the latter from metal disc 37, i.e., move magnets 38 from metal disc 37.

Preferably, magnets 38 are larger than magnets 33, and magnets 38 generate a magnetic field stronger than magnets 33 do. However, magnets 38 can be as large as magnets 33, and each magnet 38 produces a same magnetic field as each magnet 33 does.

When metal disc 32 is rotated to intersect the magnetic field produced by magnets 33, produced in impedance unit 31 is an Eddy Current that impedes the rotation of metal disc 32 relative to magnets 33. Hence, magnets 33 exert a torque against the rotation of metal disc 32.

When metal disc 37 is rotated to intersect the magnetic field produced by magnets 38, produced in impedance unit 36 is an Eddy Current that impedes the rotation of metal disc 37 relative to magnets 38. Hence, magnets 38 exert a torque against the rotation of metal disc 37.

At any given rotational rate of roller 13, metal disc 37 is rotated faster than metal disc 32 due to the combination of pulleys 24 and 25 with transmitting belt 26. Hence, at any given rotational rate of roller 13, the Eddy Current produced in metal disc 37 by magnets 38 is larger than that is produced in metal disc 32 by magnets 33 since the rotational rate of metal disc 37 is higher than that of metal disc 32.

In a first mode, only impedance unit 31 is used. That is, only magnets 33, which are attached to swinging element 34, are located near metal disc 32. In a second mode, only impedance unit 36 is used. That is, only magnets 38, which are attached to swinging element 39, are located near metal disc 37. In a third mode, both of impedance units 31 and 36 are used. That is, magnets 33 are located near metal disc 32, and magnets 38 are located near metal disc 37.

At any given rotational rate of roller 13, the torque exerted by impedance unit 31 against the rotation of roller 13 via transmission unit 20 (in the first mode) is smaller than the torque exerted by impedance unit 36 against the rotation of roller 13 via transmission unit 20 (in the second mode). Moreover, the torque exerted by impedance unit 36 against the rotation of roller 13 via transmission unit 20 (in the second mode) is smaller than the torque exerted by impedance units 31 and 36 against the rotation of roller 13 via transmission unit 20 (in the third mode).

Figure 3:
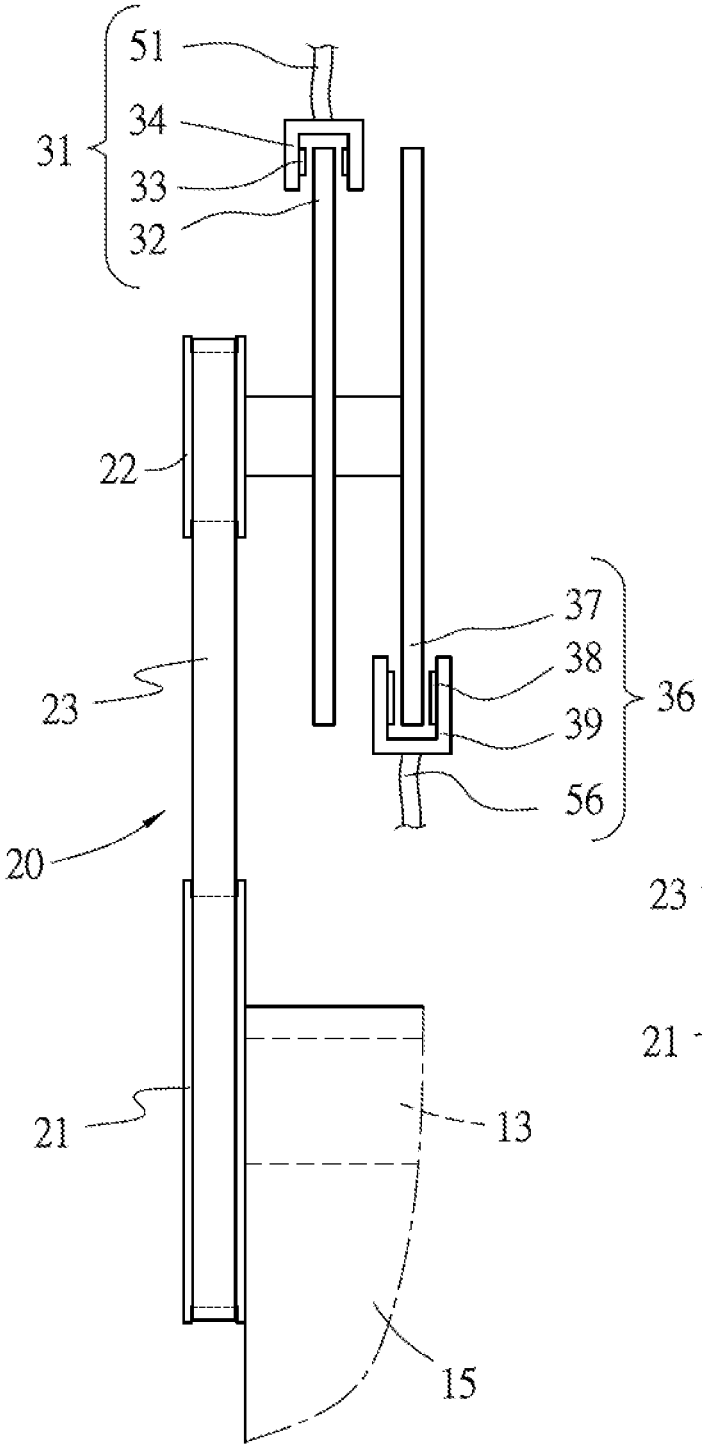
FIG. 3 is a top view of a transmission unit and an impedance system according to the second embodiment of the present invention.

Referring to FIG. 3, there is an exercise machine according to a second embodiment of the present invention. The second embodiment is like the first embodiment except for several things. Firstly, transmission unit 20 includes only pulleys 21 and 22 and transmitting belt 23. Secondly, both of discs 32 and 37 are coaxially connected to pulley 22. Preferably, magnets 38 are larger than magnets 33, and magnets 38 generate a magnetic field stronger than magnets 33 do.

Figure 4:
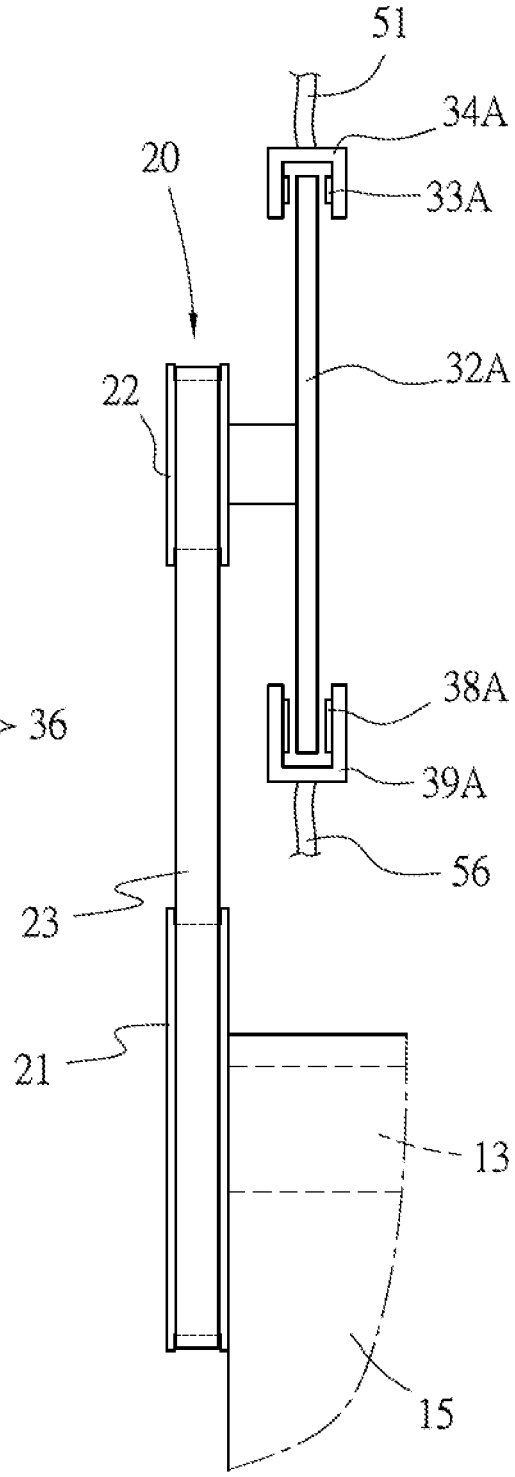
FIG. 4 is a top view of a transmission unit and an impedance system according to the third embodiment of the present invention.

Referring to FIG. 4, there is an exercise machine according to a third embodiment of the present invention. The third embodiment is identical to the second embodiment except for that the impedance system 30 includes only one metal disc 32A, at least one pair of magnets 33A, at least one pair of magnets 38A and two swinging elements 34A and 39A. Metal disc 32A includes a portion located between magnets 33A and another portion located between magnets 38A. Magnets 33A are attached to swinging element 34A to which a cable 51 is tied. Magnets 38A are attached to swinging element 39A to which a cable 56 is tied. Preferably, magnets 38A are larger than magnets 33A, and magnets 38A generate a magnetic field stronger than magnets 33A do.

Figure 5:
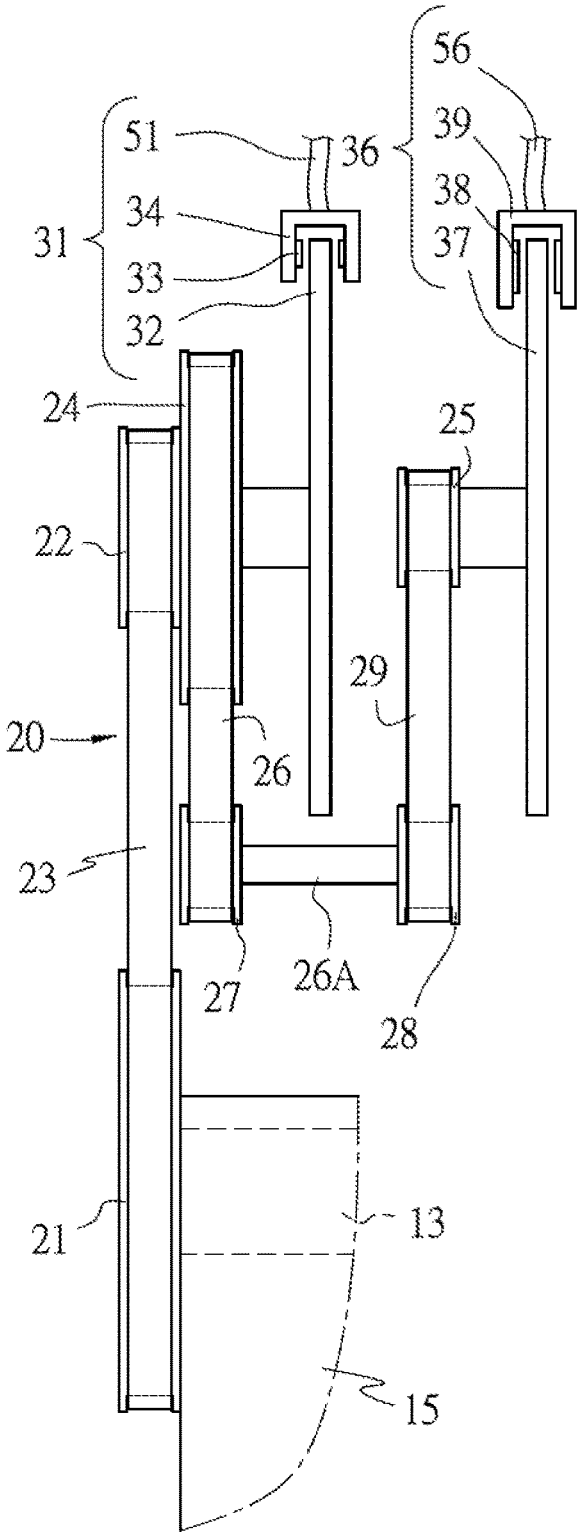
FIG. 5 is a top view of a transmission unit and an impedance system according to the fourth embodiment of the present invention.

Referring to FIG. 5, there is an exercise machine according to a fourth embodiment of the present invention. The fourth embodiment is like the first embodiment except for several things. Firstly, in transmission unit 20, pulley 25 extends parallel to pulleys 22 and 24. Secondly, an axle 26A, two pulleys 27 and 28 and a transmitting belt 29 are used in addition. Pulleys 27 and 28 are supported on axle 26A. Thirdly, transmitting belt 29 is wound on pulleys 28 and 25. Fourthly, transmitting belt 26 is wound on pulleys 27 and 24. That is, pulley 24 is connected to pulley 25 via transmitting belt 26, pulley 27, axle 26A, pulley 28 and transmitting belt 29 instead of only transmitting belt 26.

Figure 6:
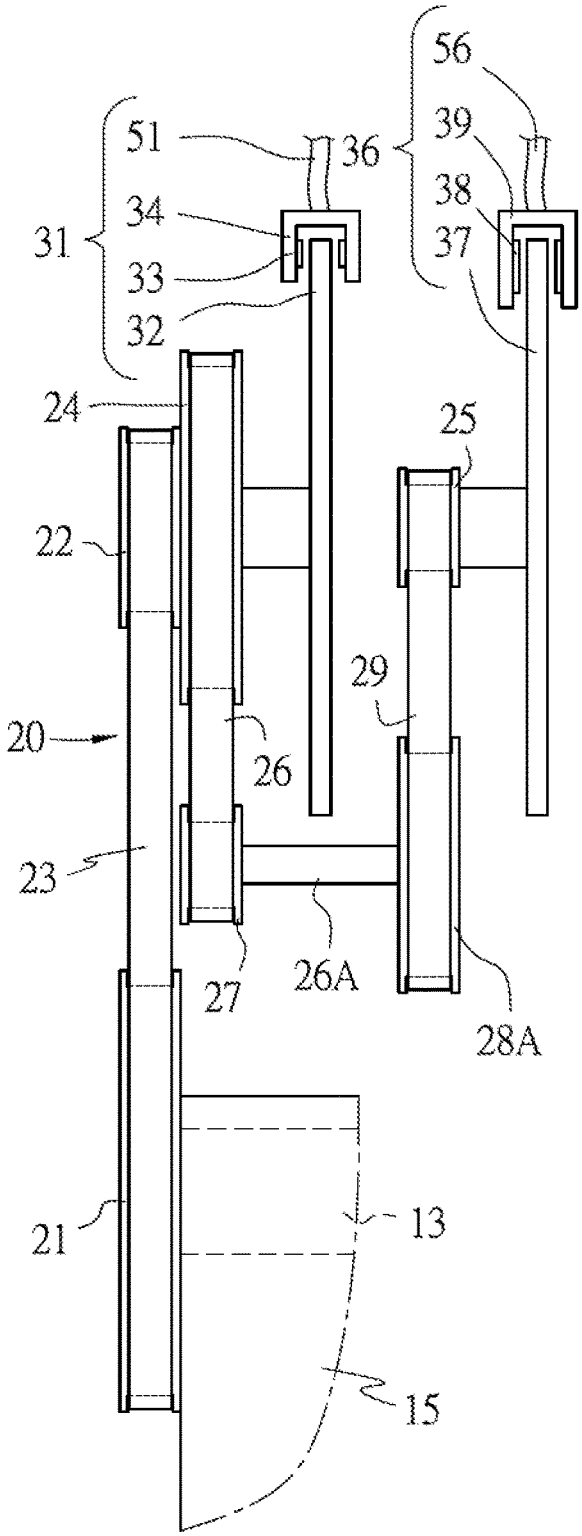
FIG. 6 is a top view of a transmission unit and an impedance system according to the fifth embodiment of the present invention.

Referring to FIG. 6, there is an exercise machine according to a fifth embodiment of the present invention. The fourth embodiment is like the fourth embodiment except for that a larger pulley 28A is used instead of pulley 28.

Figure 7:
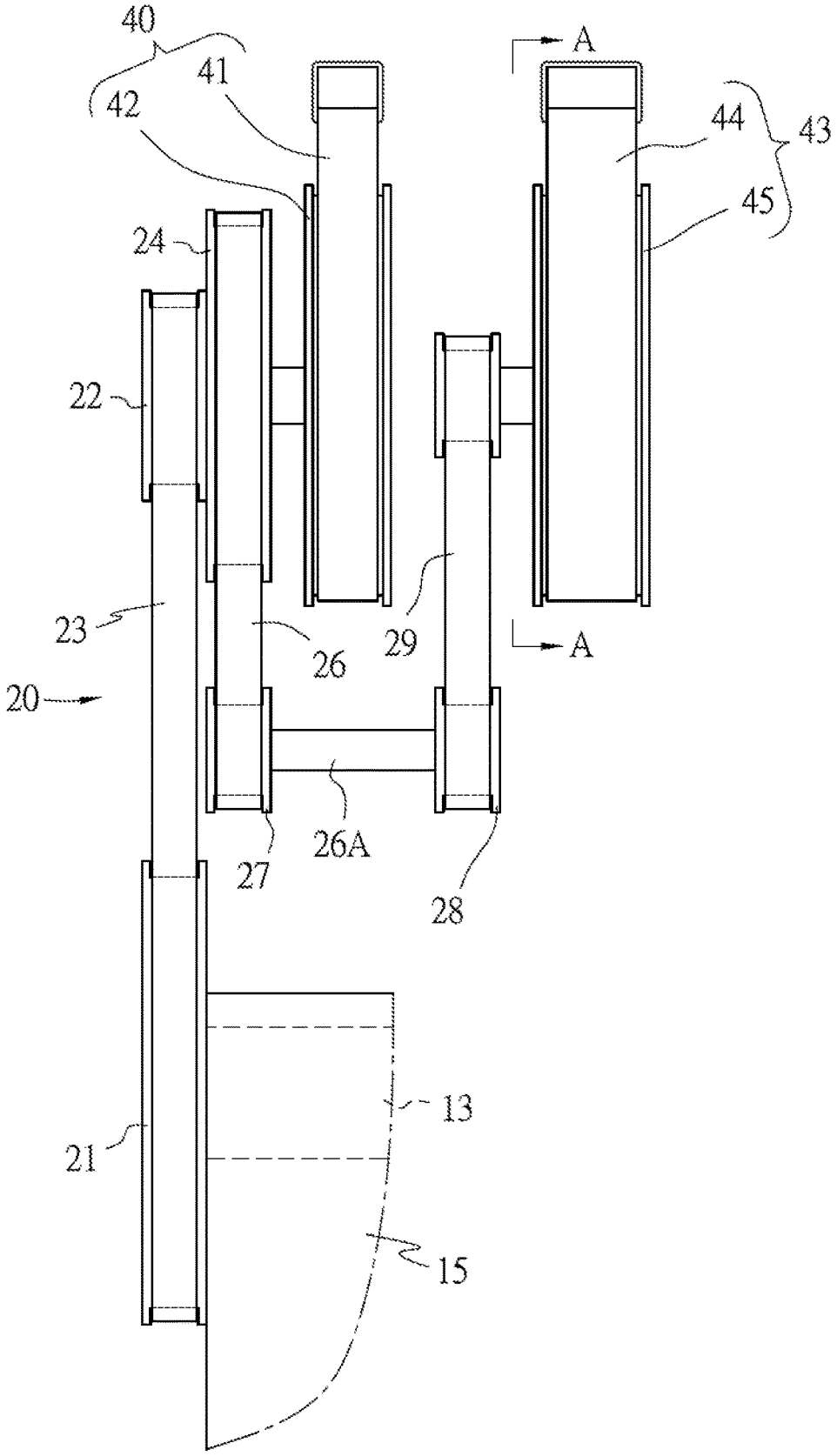
FIG. 7 is a top view of a transmission unit and an impedance system according to the sixth embodiment of the present invention.
Figure 8:
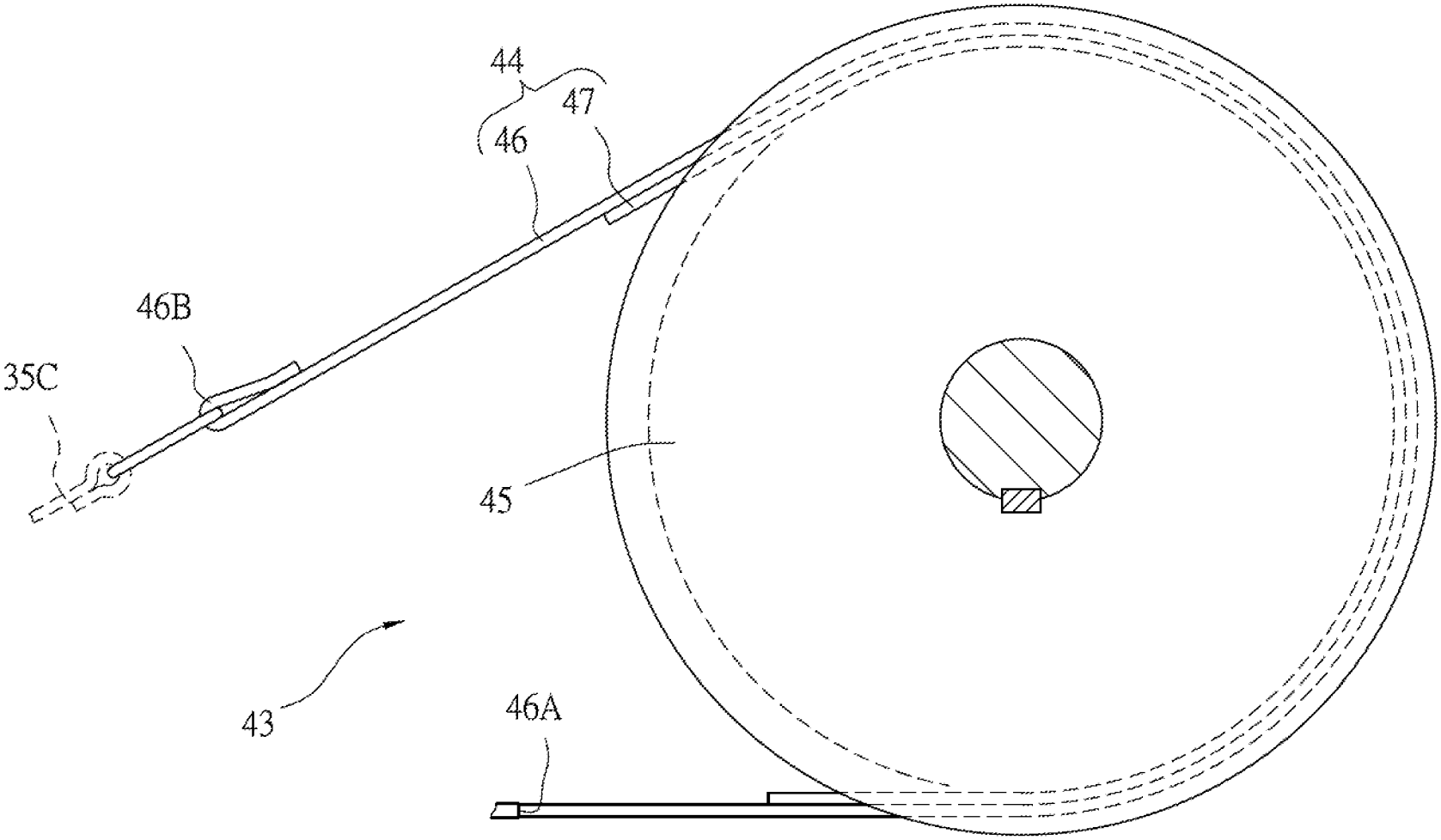
FIG. 8 is a cross-sectional view of the transmission unit and the impedance system taken along a line A-A shown in FIG. 7.

Referring to FIGS. 7 and 8, there is an exercise machine according to a sixth embodiment of the present invention. The sixth embodiment is identical to the fourth embodiment except for several things. Firstly, a frictional impedance unit 40 is used instead of magnetic impedance unit 31. Frictional impedance unit 40 includes a reducing belt 41 and a frictional pulley 42. Secondly, a frictional impedance unit 43 is used instead of magnetic impedance unit 36. Frictional impedance unit 43 includes a reducing belt 44 and a frictional pulley 45. Reducing belt 41 is made with smaller width than reducing belt 44.

Frictional impedance units 40 and 43 are otherwise identical to each other. Therefore, only frictional impedance unit 43 will be described in detail as an example Reducing belt 44 includes a metal belt 46 and a wear-resistant 47. Metal belt 46 is flexible element made with a stationary end 46A connected to frame 11 of exercise machine 10 (FIG. 1) and a movable end 46B connected to a cable 35C. Metal belt 46 includes an internal face near frictional pulley 45. Wear-resistant 47 includes an eternal face attached to the internal face of metal belt 46 and an internal face located opposite to the external face. Cable 35C is operable to change the distance of the internal face of metal belt 46 from the periphery of frictional pulley 45. There is friction between metal belt 46 and frictional pulley 45 when they are in contact with each other, thereby exerting impedance on training unit via transmission unit 20.

As mentioned above, reducing belt 41 is made with smaller width than reducing belt 44, and the area of contact of reducing belt 41 with frictional pulley 42 is hence smaller that of reducing belt 44 with frictional pulley 45. Therefore, the first frictional impedance unit 40 exerts a smaller value of impedance than frictional impedance unit 43 does.

Figure 9:
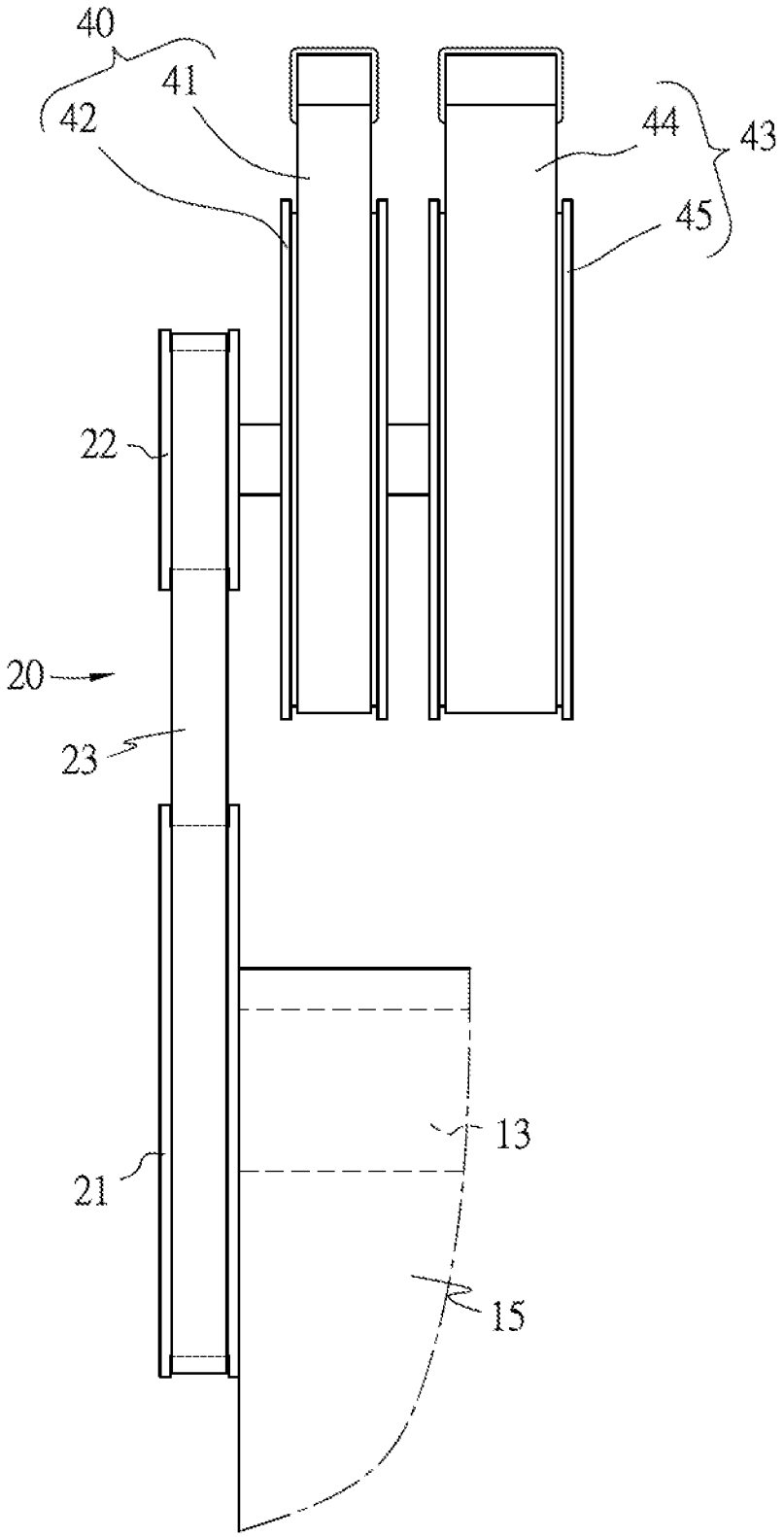
FIG. 9 is a top view of a transmission unit and an impedance system according to the seventh embodiment of the present invention.

Referring to FIG. 9, there is an exercise machine according to a seventh embodiment of the present invention. The seventh embodiment is identical to the second embodiment except for several things. Firstly, a frictional impedance unit 40 is used instead of magnetic impedance unit 31. Secondly, a frictional impedance unit 43 is used instead of magnetic impedance unit 36. Frictional impedance units 40 and 43 will not be described in detail again for having been described in detail referring to FIGS. 7 and 8.

The present invention has been described via illustration of the embodiments. Those skilled in the art can derive variations from the embodiments without departing from the scope of the present invention. Therefore, the embodiments shall not limit the scope of the present invention defined in the claims.

The invention claimed is:

1. An exercise machine comprising:

a training unit comprising a frame and a roller supported on the frame;

a transmission unit connected to the roller;

an impedance system comprising several impedance units adapted for selective connection to the transmission unit so that the selected impedance unit exerts impedance on the training unit via the transmission unit, wherein the impedance units exert different values of impedance on the training unit via the transmission unit, and each of the impedance units comprises:

a swinging element pivotally connected to the frame;

at least one pair of magnets connected t to the swinging element; and a metal disc connected to the transmission unit so that they are rotatable together, wherein the metal disc is located between the magnets, wherein the swinging element is operable to move the magnets to and from the metal disc.

2. The exercise machine according to claim 1, wherein the magnets are permanent magnets.

3. The exercise machine according to claim 1, wherein the magnets generate an Eddy Current in the metal disc of each of the impedance units different than the magnets generate in the metal disc of any other one of the impedance units.

4. The exercise machine according to claim 3, wherein the magnets of the first magnetic impedance unit are smaller than the magnets of the second magnetic impedance unit.

5. An exercise machine comprising:

a training unit comprising a frame and a roller supported on the frame;

a transmission unit connected to the roller;

an impedance system comprising several impedance units adapted for selective connection to the transmission unit so that the selected impedance unit exerts impedance on the training unit via the transmission unit, wherein the impedance units exert different values of impedance on the training unit via the transmission unit, and each of the impedance units comprises:

a frictional pulley connected to the transmission unit so that they are rotatable together; and a reducing belt comprising a stationary end connected to the frame and a movable end operable to move the reducing belt to and from the frictional pulley.

6. The exercise machine according to claim 5, wherein the reducing belts of the frictional impedance units are made with different values of width.

7. The exercise machine according to claim 5, wherein each of the reducing belt comprises:

a metal belt formed with the stationary end and the movable end; and a wear-resistant element comprising an external face attached to the metal belt and an internal face for contact with the frictional pulley.

8. An exercise machine comprising:

a training unit comprising a frame and a roller supported on the frame;

a transmission unit connected to the roller; and an impedance system comprising:

a metal disc connected to the transmission unit so that they are rotatable together;

a first swinging element connected to the frame;

a second swinging element connected to the frame;

a first pair of magnets connected to the first swinging element; and a second pair of magnets connected to the second swinging element, wherein the first swinging element is operable to move the first pair of magnets to the disc, wherein the second swinging element is operable to move the second pair of magnets to the disc.

9. The exercise machine according to claim 8, wherein the first and second pairs of magnets comprises permanent magnets.

10. The exercise machine according to claim 8, wherein the first pair of magnets generates an Eddy Current in the metal disc stronger than the second pair of magnets does.

11. The exercise machine according to claim 10, wherein the first pair of magnets is smaller than the second pair of magnets.

* * * * *